US006164449A

United States Patent [19]

Lahti

[11] Patent Number: 6,164,449

[45] Date of Patent: Dec. 26, 2000

[54] REFILL PACK

[75] Inventor: Arto Lahti, Kerava, Finland

[73] Assignee: Labsystems Oy, Finland

[21] Appl. No.: 09/337,602

[22] Filed: Jun. 21, 1999

[30] Foreign Application Priority Data

Sep. 8, 1998 [FI] Finland ..... 981919

[51] Int. Cl.[7] ..... B65D 85/00; B65D 21/00

[52] U.S. Cl. ..... 206/499; 206/443; 53/245; 422/100; 422/104; 229/101.1

[58] Field of Search ..... 206/443, 499, 206/486, 560, 562, 563, 488, 489, 589, 814; 211/60.1, 74; 422/100, 102, 104; 220/529; 53/245, 260; 229/101.1

[56] References Cited

U.S. PATENT DOCUMENTS

| | | | |
|---|---|---|---|
| 4,826,012 | 5/1989 | Kosanovich | 206/499 |
| 5,217,164 | 6/1993 | Sullivan . | |
| 5,392,914 | 2/1995 | Lemieux et al. | 206/499 |
| 5,441,702 | 8/1995 | Lemieux et al. | 206/499 |
| 5,470,016 | 11/1995 | Ljungstrom et al. | 229/101.1 |
| 5,470,538 | 11/1995 | Lind | 206/443 |
| 5,779,984 | 7/1998 | Kelly et al. | 206/486 |

FOREIGN PATENT DOCUMENTS

WO 95/08392 3/1995 WIPO .

OTHER PUBLICATIONS

International Search Report; FI 981919; Examiner Timo Maunola; Search Date Feb. 16, 1999.

*Primary Examiner*—Paul T. Sewell
*Assistant Examiner*—Luan K. Bui
*Attorney, Agent, or Firm*—Fish & Richardson P.C.

[57] ABSTRACT

A pipette tip refill pack has several layers of pipette tips stacked upside down in a telescopic fashion. From the pack, the tips can be dispensed to a tip rack which is positioned upside down on top of the topmost tip layer.

30 Claims, 5 Drawing Sheets

II
17
13
13
15
16
14
14
6
14
14
14
14
15
14
14
II

REFILL PACK

FIELD OF THE INVENTION

The invention belongs to the field of laboratory technology and relates to a refill pack of a pipette tip rack, from which an empty rack can be refilled. Thus a pipette can be provided with replacement tips from said rack whenever necessary.

BACKGROUND OF THE INVENTION

Pipettes that are conventionally used in laboratories comprise a replaceable tip container or tip, where the substance to be dosed is first sucked in. The tip is usually conical and is attached by friction to the respectively conical bottom end of the pipette suction cylinder for sucking liquid into the tip through its lower end. Traditionally the tips are fastened manually to the pipette. Generally the tips are wider at the top, and they are placed in holes provided in a particular tip rack, said holes being smaller than said wider top parts. From the rack, the tips can then be picked by pressing the lower end of the pipette onto the top part of the tip without manually touching the tip. Thus also in the case of a multichannel pipette, all tips can be replaced at the same time, when the rack includes tips in rows, each row containing exactly the required number of tips. Naturally the rack supplied along with the tips costs money, adds to the volume of the dispatch and increases the amount of waste created in the laboratory.

In the patent application WO 95/08392 (corresponding to Lemieux et al. U.S. Pat. No. 5,441,702) there is introduced a refill pack to be used together with the tip rack, from which refill pack the empty tip rack can be refilled. The refill pack includes several layers of tips stacked in a telescopic fashion. The lowest layer rests in holes provided in a carrier plate, wherefrom it is pushed through the plate to the rack positioned underneath. In the embodiment illustrated in FIG. 7, the top layers always rest on the lowest layer. At the edges of the holes provided in the carrier plate, there are formed radial cuts, so that in between said cuts, there are left flexible strips, and the tips are supported by said strips. The tip rack to be refilled is positioned underneath the refill pack, and when the tips are pressed downwardly from above, the strips give way and the tips are pushed through the holes to the holes provided in the tip rack and located underneath. For pressing, the pack is provided with a special push plate located on top of the topmost tip layer. The refill pack is surrounded by a shell, and the shell bottom comprises a widening skirt that facilitates the focusing of the pack above the tip rack. As the tip layers are one by one released from the bottom of the pack, the push plate is lowered down layer by layer inside the pack. In order to release the last layers, the user must put his hand deep into the pack. In spite of this, the refill packs available in the market have so far been only of the type illustrated in FIG. 11 of said publication (FIG. 10 of the corresponding U.S. patent), with separate support plates additionally provided in between the tip layers.

SUMMARY OF THE INVENTION

The present invention introduces novel refill packs for a pipette tip rack according to the appended patent claims.

A first object of the invention is a refill pack where the tips are placed upside down, i.e. so that the top part of the tip, which is fastened to the pipette, is positioned at the bottom of the pack. From the pack, the tips can be dispensed to a tip rack to be positioned upside down on top of the topmost tip layer.

On top of the topmost tip layer, in the pack there can be added a push plate provided with a hole at each tip and with spring members, so that when the plate is pressed down, the spring members give way and the plate slides along the tip to underneath it. Now the tips can be set in the tip rack that is positioned upside down. The spring members can be separate or they can be permanently connected to the plate. They can be for example flaps that extend inwardly from the hole edge.

In the pack, the tips can at their wider top end be supported against the pack bottom plate. Moreover, when tips are being dispensed, said bottom plate can be held against the table. Thus the tips can be solidly packed in a space as small as possible, and the push plate does not have to be specially strong, which allows for the use of less packing material as well as cheaper, recyclable packing materials. Support plates are not needed in between the tip layers, which further reduces the amount of material needed for packing.

A second object of the invention is a refill pack with a push plate with a hole for each tip, which push plate is moved in relation to the tips which are kept steady so that the plate glides along the surface of the tips beyond the upper end of the tip.

A third object of the invention is a refill pack provided with an outer shell that can be made lower layer by layer. The shell may comprise successive layers composed of paper or plastic strips.

BRIEF DESCRIPTION OF THE DRAWINGS

The appended drawings form part of the detailed description of the invention.

DETAILED DESCRIPTION OF A PREFERRED EMBODIMENT OF THE INVENTION

Figure 1:
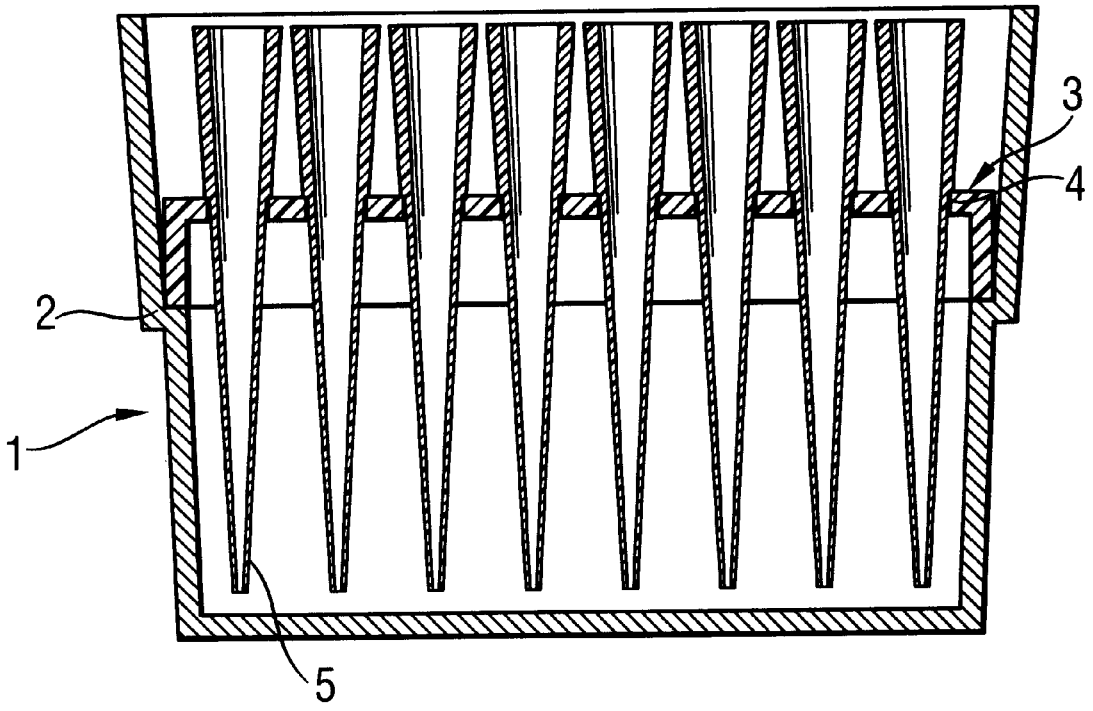
FIG. 1 illustrates a pipette tip rack seen in a front-view cross-section.

The pipette tip rack 1 according to FIG. 1 comprises a box 2, with an upwardly widening top part. At the junction of the top and bottom parts, the inner wall of the box is provided with a protruding shoulder that runs along the wall. On top of said shoulder, there is placed a perforated plate 3 with downwardly extending walls. The top surface of the plate includes holes 4 in a 8×12 matrix. In said holes, there are inserted tips 5. The bottom part of the tips is narrower and the top part wider than the holes provided in the perforated plate. Thus the tips can be placed in said holes, and they rest lightly on the hole edges without getting stuck. The top part of inserted tips remains somewhat below the top edge of the box. From the plate, tips can be attached to a pipette by pressing the bottom end of the pipette to the top end of the tip. Most advantageously the tip rack is made of some plastic suitable for this purpose.

The tip 5 has a conical bottom part and a wider conical top part. The outer diameter of the bottom edge of the top part is larger than the inner diameter of the top edge. The inner diameter of the top edge of the top part is larger than the outer diameter of the top edge of the lower part. Thus tips can be stacked in a telescopic fashion without getting stuck.

Figure 2:
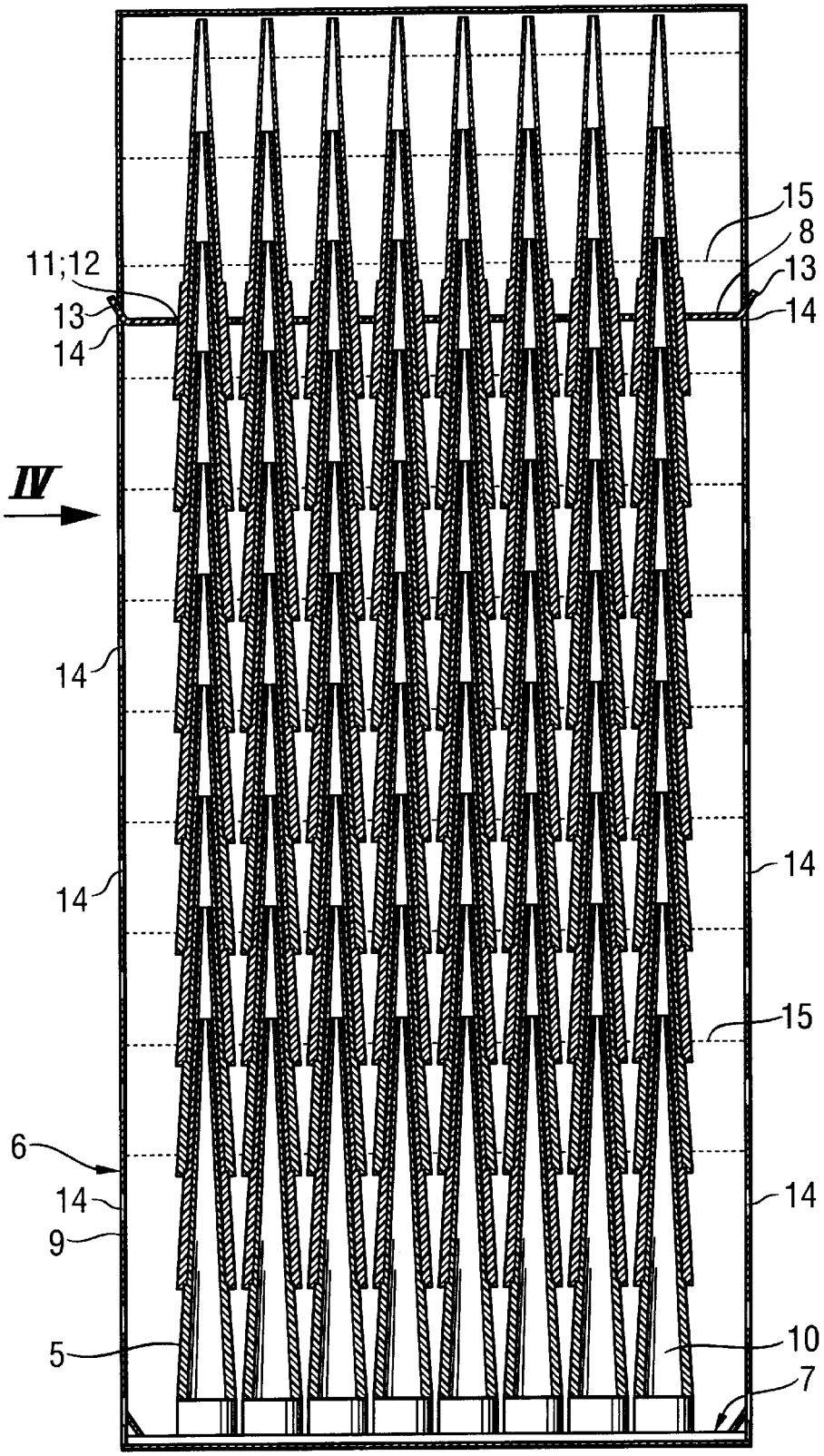
FIG. 2 illustrates a refill pack to be used together with the pipette tip rack of FIG. 1, seen in cross-section.

The refill pack 6 according to FIG. 2 comprises a bottom plate 7, a push plate 8 and a shell 9. In a matrix corresponding to the holes 4 of the perforated plate 3 of FIG. 1, there are provided pins 10. The pins have a wider bottom part and a top part that is narrower than the top part of the tip 5, but otherwise corresponding to the conical shape thereof. To each pin, a tip is positioned upside down. On top of the lowest tip layer, there are stacked additional layers.

Figure 3:
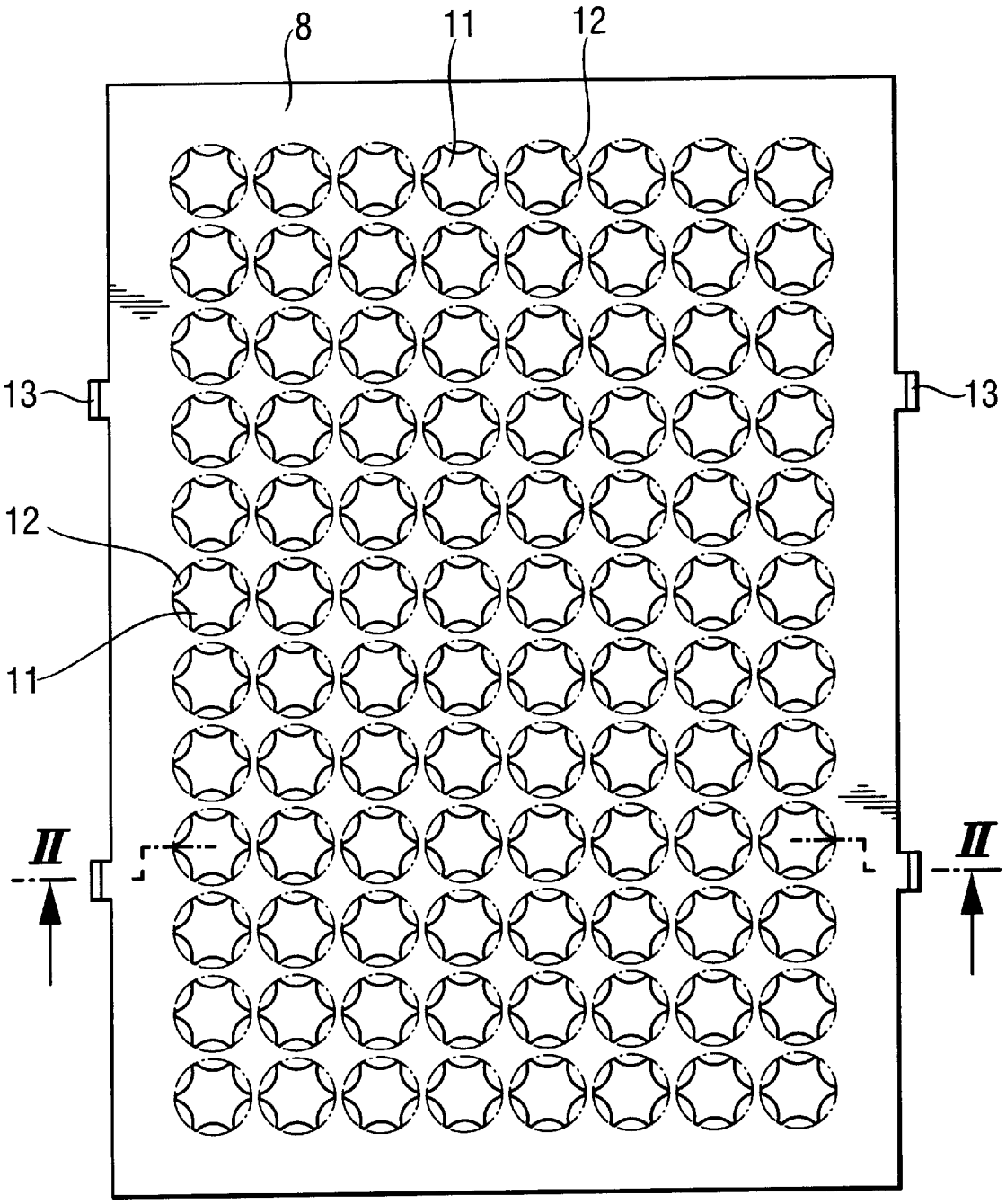
FIG. 3 is a top-view illustration of the tip push plate provided in the pack.
Figure 4:
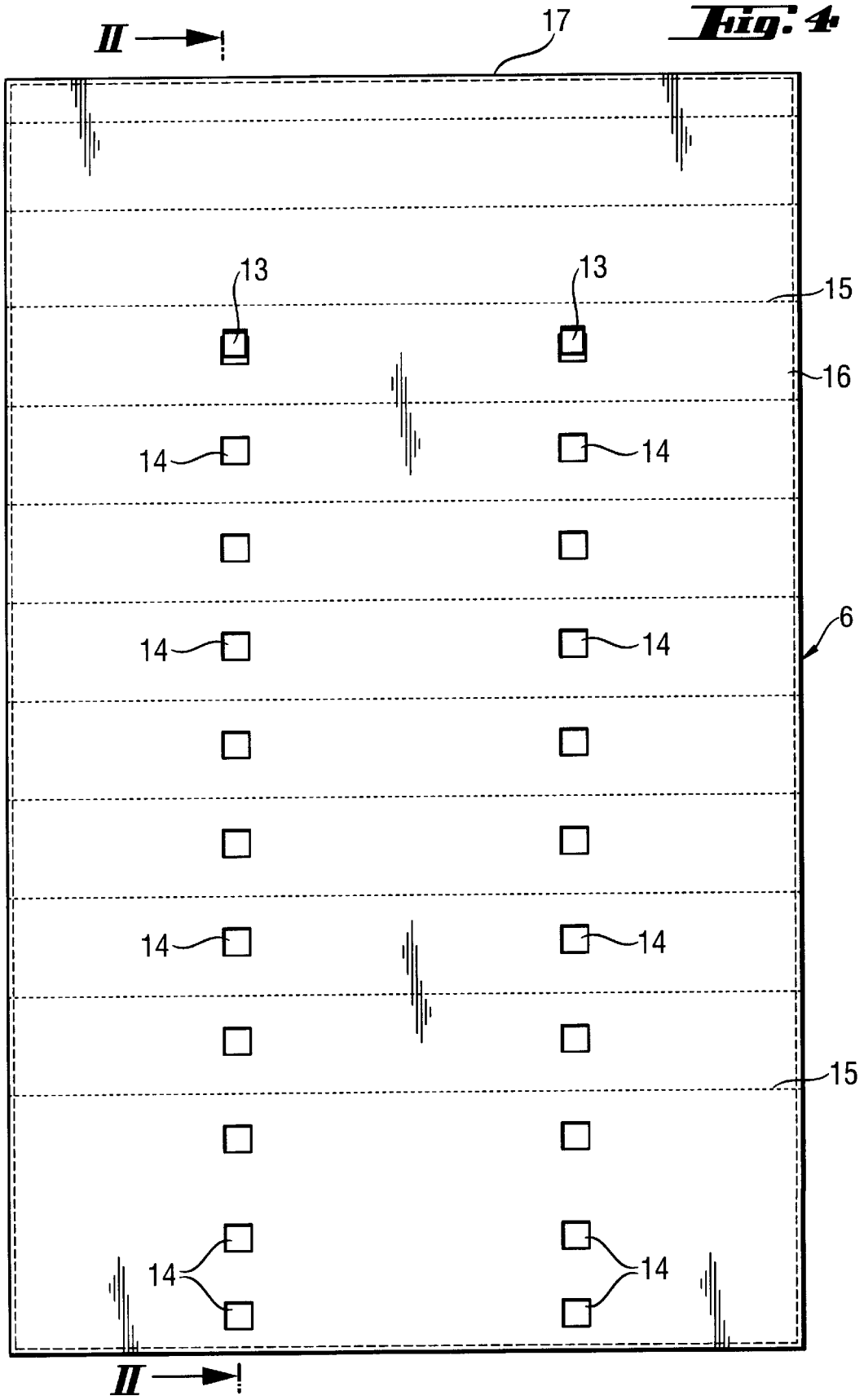
FIG. 4 is a side-view illustration of the pack of FIG. 2, seen (in smaller scale) from outside.

On top of the topmost tip layer, there is placed a push plate 8. Said push plate comprises, in correspondence to the matrix of the tip layer, push holes 11 with a diameter larger than the diameter of the top part of the tip (FIG. 3). The edge of the push hole is provided with inwardly extending, flexible flaps 12. When the plate positioned on top of an inverted tip is pressed down, the flaps give way, so that the plate slides to underneath the tip. The flaps are arched in shape and six in number, and they are arranged symmetrically around the hole. The smallest diameter of the hole defined by said flaps is larger than the diameter of the bottom end of the top part of the tip. Thus the plate positioned on top of the inverted tips is placed at the top part of the tip.

On both sides of the push plate 8, there are provided two brackets 13 extending to outside the shell. The bracket ends are directed in an upwardly inclined position. At the sides of the shell 9, at each tip layer, there are provided notches 14 where the brackets fit in, when the push plate is placed at the top part of the pipettes of the layer in question. The shell and the push plate brackets are somewhat flexible, so that the plate can be made to move within the shell by pressing it. Owing to these brackets and notches, the plate and the tips remain tightly and securely packed inside the pack, although it is turned upside down.

The bottom plate 7 and the push plate 8 are advantageously made of some plastic suitable for the purpose. The shell 9 is advantageously made of some cardboard or carton suitable for the purpose.

Figure 5:
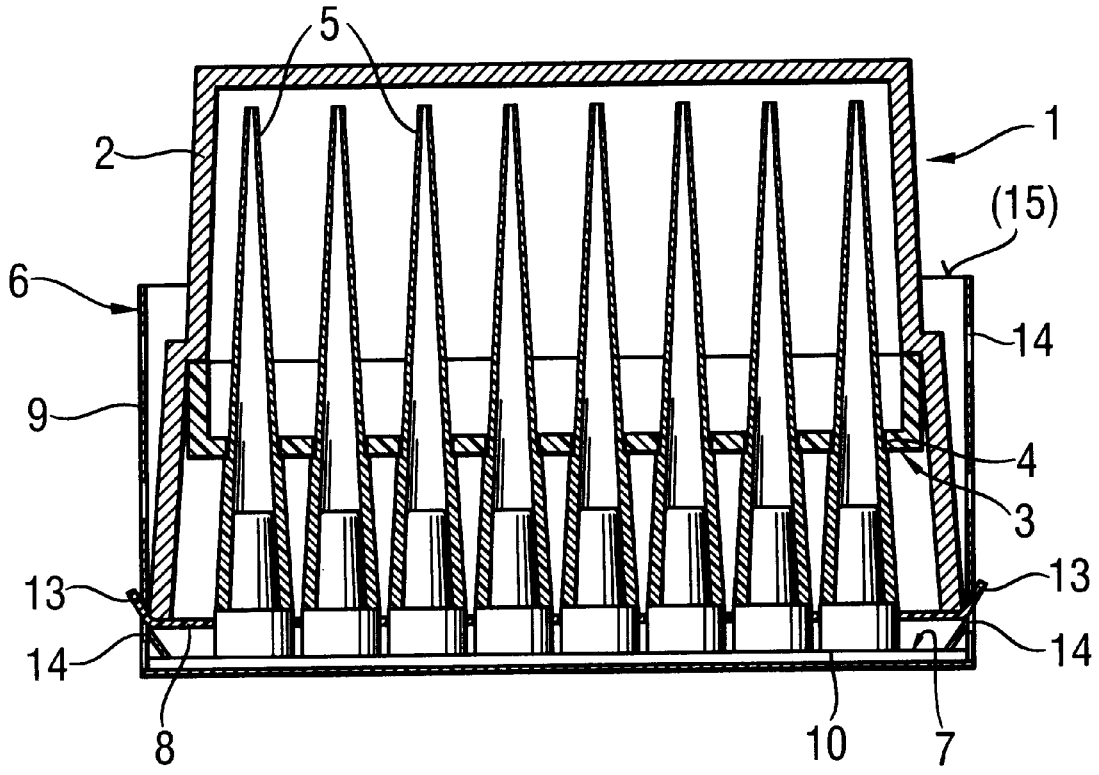
FIG. 5 illustrates in cross-section how the tip rack of FIG. 1 is refilled from the pack of FIG. 2.

When an empty tip rack 1 should be refilled, it is placed upside down on top of the tip stack contained in an opened refill pack 2, so that the tips 5 match in the holes 4. Now the top edge of the rack is placed against the push plate 8. At this stage, the push plate is located at the topmost tip layer. The rack is pressed downwards, so that the flaps 12 provided in the push plate give way, and the push plate slides through the topmost tip layer. Finally the rack and the pack are together turned around, the grip of the rack is released and the pack is lifted off the rack and turned around again. FIG. 5 illustrates how the last layer of the tip stack is dispensed.

During the use and storage of the pack 6, the bottom plate 7 is permanently supported against the bottom of the shell 9. When dispensing the tips, the bottom plate is supported via the shell against the table, in which case any special strength is not required of it.

In the pack 6, the tips 5 rest on the bottom plate 7, and the push plate 8 only keeps the tips in place in the matrix. During normal transportation and storage, the tips should not be easily pushed through the push plate by accident. During dispensing, the push plate 8 is supported against the rack. The tips remain supported by the push plate only for a short while at the final stage of the dispensing process. Thus any special strength is not required of the push plate, either.

The push plate 8 does not need to hold the tips 5 in the pack during transportation and storage. Thus the flaps 12 can be made so that their resisting strength is as small as possible. This is an important advantage, and the more important, the more there are tips in the matrix in question. Owing to the small resisting strength, also the strength required of the pack is smaller, in which case it is further possible to save in material expenses. Moreover, the dispensing is always carried out more pleasantly, the smaller the strength that should be applied.

The shell 9 is perforated throughout by horizontal lines 15, so that the shell is composed of tear-off strips 16. When a new pack is opened, first the topmost strip is torn off, so that the lid 17 is removed. Along with removing tip layers from the pack, strips are torn off at the top edge. Thus it is not necessary to insert the rack 1 deep inside the shell. The pack also takes up less and less space along with the dispensing of the tips. Moreover, the user can easily decide, on the basis of the height of the pack, how many tips there are left, even if the shell is made of some opaque material. Between dispensing operations, the shell can be covered with the lid, which now protects the tips from dust, for example.

What is claimed is:

1. A pipette tip refill pack comprising:

a plurality of pipette tips contained within a volume, each pipette tip having an elongate tapering shape, from an open proximal base end to a relatively more narrow open distal tip end, said plurality of pipette tips arranged in stacks of several layers of arrays of pipette tips, pipette tips in each stack being stacked in telescopic fashion, with proximal base ends engaged over distal tips ends of a next lower layer, base ends of pipette tips in a lowermost layer resting upon a bottom support surface, and a push plate defining an array of holes corresponding to the array of pipette tips, with distal tip ends of pipette tips of an uppermost layer of pipette tips initially received through the array of holes in said push plate and held in horizontally-supporting engagement by said push plate, said push plate being adapted for downward step-wise advancement, toward the bottom support surface, over base ends of successive layers of pipette tips held in horizontally-supporting engagement, releasing the array of pipette tips of each successive layer from horizontally-supporting engagement, for removal of a released layer of an array of pipette tips with a pipette rack, to engage over an array of pipette tips of a successively next-lower layer of pipette tips in horizontally-supporting engagement.

2. A pipette tip refill pack according to claim 1, holes of said array of holes defined by said push plate being provided with a spring element.

3. A pipette tip refill pack according to claim 2, wherein the spring element comprises inwardly extending flaps.

4. A pipette tip refill pack according to any of the claims 1, 2, or 3 wherein the bottom support surface underneath the proximal base ends of the pipette tips in the lowermost layer is provided by a bottom plate.

5. A pipette tip refill pack according to claim 4, wherein said bottom plate further comprises pins upstanding from said bottom support surface to engage through base ends of pipette tips in the lowermost layer, with positions matching those of said pipette tips in the array of pipette tips.

6. A pipette tip refill pack according to claim 1, further comprising a shell, wherein said volume containing the plurality of pipette tips arranged in stacks of several layers are surrounded by said shell.

7. A pipette tip refill pack according to claim 6, said shell comprising, in the vertical direction, successive removable layers.

8. A pipette tip refill pack according to claim 7, wherein the successive removable layers are separated from each other by generally horizontal perforations.

9. A pipette tip refill pack according to claim 8, wherein said push plate comprises brackets and said shell defines a series of corresponding notches positioned to receive said brackets of said push plate at successive layers of pipette tips during the downward step-wise advancement of said push plate.

10. A pipette tip refill pack comprising a plurality of pipette tips contained within a volume, each pipette tip having an elongate tapering shape, from an open proximal base end to a relatively more narrow open distal tip end, said plurality of pipette tips arranged in stacks of several layers of arrays of pipette tips, the pipette tips in each stack being stacked in telescopic fashion, with proximal base ends engaged over distal tips ends of an adjacent layer, and a push plate defining an array of holes corresponding to the array of pipette tips, pipette tips of a layer of pipette tips being initially received through the array of holes in said push plate and held in horizontally-supporting engagement by said push plate, said push plate adapted for step-wise advancement over successive layers of pipette tips, said push plate holding each successive layer in horizontally-supporting engagement, and then releasing the layer, for removal of the array of pipette tips with a pipette rack, to engage over an array of pipette tips of a successively next layer of pipette tips in horizontally-supporting engagement, and said plurality of pipette tips within said volume, during advancement of the push plate through the successive layers, remaining in constant position relative to a bottom support surface.

11. A pipette tip refill pack according to claim 10, wherein an outermost layer of pipette tips have distal tip ends outwards and initially received through the array of holes of said push plate.

12. A pipette tip refill pack according to claim 11, wherein holes of said array of holes defined by said push plate are provided with a spring element.

13. A pipette tip refill pack comprising: a plurality of pipette tips contained within a volume, each pipette tip having an elongate tapering shape, from an open proximal base end to a relatively more narrow open distal tip end, said plurality of pipette tips arranged in stacks of several layers of arrays of pipette tips, the pipette tips in each stack being stacked in telescopic fashion, with proximal base ends engaged over distal tips ends of an adjacent layer, and a surrounding shell defining said volume, the shell being composed, in a vertical direction, of successive removable layers.

14. A pipette tip refill pack according to claim 13, wherein on top of an outermost layer of pipette tips having distal tip ends outwards, there is placed a push plate provided with a hole at each pipette tip.

15. A pipette tip refill pack according to claim 13, wherein said successive removable layers of said surrounding shell are adapted to be removed in succession starting with a first layer at an upper vertical end of said surrounding shell.

16. A method for dispensing pipette tips from a pipette tip refill pack into a pipette tip rack, the pipette tip refill pack containing a plurality of pipette tips within a volume, each pipette tip having an elongate tapering shape, from an open proximal base end to a relatively more narrow open distal tip end, the plurality of pipette tips in the refill pack being arranged in stacks of several layers of arrays of pipette tips, each stack being stacked in telescopic fashion, with proximal base ends engaged over distal tips ends of a next lower layer and proximal base ends of pipette tips in a lowermost layer resting upon a bottom support surface, and a push plate defining an array of holes corresponding to the array of stacks of pipette tips, with distal tip ends of pipette tips of an uppermost layer of pipette tips initially received through the array of holes in the push plate and held in horizontally-supporting engagement by the push plate, said method comprising the steps of:

a) with the pipette tip refill pack resting upon a bottom support surface, placing a pipette tip rack in inverted orientation over the uppermost layer of pipette tips in the pipette refill pack;

b) urging the pipette tip rack upon the array of pipette tips to advance the push plate over the base ends of the pipette tips in the uppermost layer, releasing that array of pipette tips from horizontally-supporting engagement, to engage over an array of pipette tips of a successively next lower layer of pipette tips in horizontally-supporting engagement;

c) turning over the pipette tip rack and the pipette tip refill pack as a unit;

d) lifting the pipette tip refill pack from the pipette tip rack, with the pipette tips of the array of pipette tips formerly in the uppermost layer now disposed in the rack;

e) returning the pipette tip refill pack to rest upon the bottom support surface; and f) repeating steps a) through e) until the plurality of pipette tips are dispensed from with the volume.

17. A method for dispensing pipette tips from a pipette tip refill pack into a pipette tip rack according to claim 16, said method comprising the further step of removably engaging the pipette tips in the holes of the push plate with a spring element.

18. A method for dispensing pipette tips from a pipette tip refill pack into a pipette tip rack according to claim 17, said method comprising the further step of removably engaging the pipette tips in the holes of the push plate with a spring element comprising inwardly extending flaps.

19. A method for dispensing pipette tips from a pipette tip refill pack into a pipette tip rack according to any of the claims 16, 17 or 18, said method comprising the further step of supporting the plurality of pipette tips upon a bottom plate below the lowest-most layer of pipette tips in the pipette tip refill pack.

20. A method for dispensing pipette tips from a pipette tip refill pack into a pipette tip-rack according to claim 19, said method comprising the further step of engaging the pipette tips of the lowest-most layer of pipette tips in the pipette tip refill pack upon pins extending from the bottom plate at positions matching the array of pipette tips in the pipette tip refill pack.

21. A method for dispensing pipette tips from a pipette tip refill pack into a pipette tip rack according to claim 16, said method comprising the further step of surrounding the plurality of pipette tips within the volume with a shell.

22. A method for dispensing pipette tips from a pipette tip refill pack into a pipette tip rack according to claim 21, said method comprising the further step of, following step e), removing successive vertical layers of the shell after corresponding layers of arrays of pipette tips are removed.

23. A method for dispensing pipette tips from a pipette tip refill pack into a pipette tip rack according to claim 22, said method comprising the further step of removing successive vertical layers of the shell along perforations provided for the purpose, after corresponding layers of arrays of pipette tips are removed.

24. A method for dispensing pipette tips from a pipette tip refill pack into a pipette tip rack according to claim 23, said method comprising the further step of engaging brackets extending from the push plate into notches defined by the shell at positions corresponding to successive layers of arrays of pipette tips within the volume of the shell.

25. A method for dispensing pipette tips from a pipette tip refill pack into a pipette tip rack, the pipette tip refill pack consisting of a plurality of pipette tips contained within a volume, each pipette tip having an elongate tapering shape, from an open proximal base end to a relatively more narrow open distal tip end, the plurality of pipette tips in the refill pack being arranged in stacks of several layers of arrays of pipette tips, each stack being stacked in telescopic fashion, with proximal base ends engaged over distal tip ends of a next lower layer and proximal base ends of pipette tips in a lowermost layer resting upon a bottom support surface, and a push plate defining an array of holes corresponding to the array of stacks of pipette tips, with distal tip ends of pipette tips of an uppermost layer of pipette tips initially received through the array of holes in the push plate and held in horizontally-supporting engagement by the push plate, said method comprising the steps of:

a) with the pipette tip refill pack resting upon a bottom support surface, placing a pipette tip rack in inverted orientation over the uppermost layer of pipette tips in the pipette tip refill pack;

b) urging the pipette tip rack upon the array of pipette tips in the uppermost layer to advance the push plate over the base ends of the pipette tips in the uppermost layer, releasing that array of pipette tips from horizontally-supporting engagement, to engage over an array of pipette tips of a successively next lower layer of pipette tips in horizontally-supporting engagement;

c) turning over the pipette tip rack and the pipette tip refill pack as a unit;

d) lifting the pipette tip refill pack from the pipette tip rack, with the pipette tips of the array of pipette tips formerly in the uppermost layer now disposed in the rack;

e) returning the pipette tip refill pack to rest upon the bottom support surface; and f) repeating steps a) through e) until the plurality of pipette tips are dispensed from with the volume.

26. A method for dispensing pipette tips from a pipette tip refill pack into a pipette tip rack according to claim 25, said method comprising the further step of placing the holes in the push plate initially over the distal tip ends of the array of pipette tips in the uppermost layer of the plurality of pipette tips in the pipette tip refill pack.

27. A method for dispensing pipette tips from a pipette tip refill pack into a pipette tip rack according to claim 26, said method comprising the further step of engaging the pipette tips extending into the holes in the push plate with a spring element.

28. A method for dispensing pipette tips from a pipette tip refill pack into a pipette tip rack, said method comprising the steps of:

surrounding, with a shell, a plurality of pipette tips contained within a volume, each pipette tip having an elongate tapering shape, from an open proximal base end to a relatively more narrow open distal tip end, the plurality of pipette tips arranged in stacks of several layers of arrays of pipette tips, the pipette tips in each stack being stacked in telescopic fashion, with proximal base ends engaged over distal tips ends from an adjacent layer; and removing the surrounding shell, in a vertical direction, in successive removable layers.

29. A method for dispensing pipette tips from a pipette tip refill pack into a pipette tip rack according to claim 28, said method comprising the further step of providing a push plate on top of an outermost layer of pipette tips having distal tip ends outwards, the push plate having a hole at each pipette tip in the outermost layer.

30. A method for dispensing pipette tips from a pipette tip refill pack into a pipette tip rack according to claim 28, said method comprising the further step of removing successive layers of the surrounding shell, starting with a first layer at an upper vertical end of the surrounding shell.

* * * * *